United States Patent [19]

Kim

[11] 4,144,378

[45] Mar. 13, 1979

[54] ALUMINIZED LOW ALLOY STEEL

[75] Inventor: Yong-wu Kim, Munster, Ind.

[73] Assignee: Inland Steel Company, Chicago, Ill.

[21] Appl. No.: 830,031

[22] Filed: Sep. 2, 1977

[51] Int. Cl.[2] ..... B32B 15/18; B32B 15/20

[52] U.S. Cl. ..... 428/653; 75/123 J; 148/12 C; 148/12 D; 427/432

[58] Field of Search ..... 75/123 J; 148/36, 12 C, 148/12 D, 12 F; 428/653; 427/432

[56] References Cited

U.S. PATENT DOCUMENTS

| | | | |
|---|---|---|---|
| 2,666,722 | 1/1954 | Epstein | 148/12 C |
| 2,825,669 | 3/1958 | Herzog | 75/124 |
| 3,404,969 | 10/1968 | Holmes | 428/653 |
| 3,642,468 | 2/1972 | Nagashima et al. | 75/123 J |
| 3,881,880 | 5/1975 | Gomersall | 428/653 |
| 3,881,881 | 5/1975 | Kim | 428/653 |
| 3,905,780 | 9/1975 | Jasper et al. | 75/124 |
| 3,997,372 | 12/1976 | Matus et al. | 148/12 F |
| 4,008,103 | 2/1977 | Miyoshi et al. | 148/12 F |

FOREIGN PATENT DOCUMENTS

| | | | |
|---|---|---|---|
| 1558445 | 8/1973 | Fed. Rep. of Germany | 75/123 J |
| 44-28782 | 11/1969 | Japan | 75/123 J |
| 354965 | 8/1931 | United Kingdom. | |

*Primary Examiner*—Arthur J. Steiner

*Attorney, Agent, or Firm*—Merriam, Marshall & Bicknell

[57] ABSTRACT

An aluminum coated low alloy low carbon killed steel sheet material which exhibits increased resistance to subsurface oxidation at elevated temperatures having incorporated in the low carbon killed steel before rolling and hot-dip aluminum coating an amount of vanadium or a combination of vanadium and titanium at least four times the weight percent carbon in the steel but not more than ten times the weight percent carbon in said steel with said amount being sufficient to combine with all the carbon and nitrogen in the steel and provide an excess of uncombined vanadium in the steel of about 0.1 wt. %.

9 Claims, 3 Drawing Figures

ALUMINIZED LOW ALLOY STEEL

Figure 1:
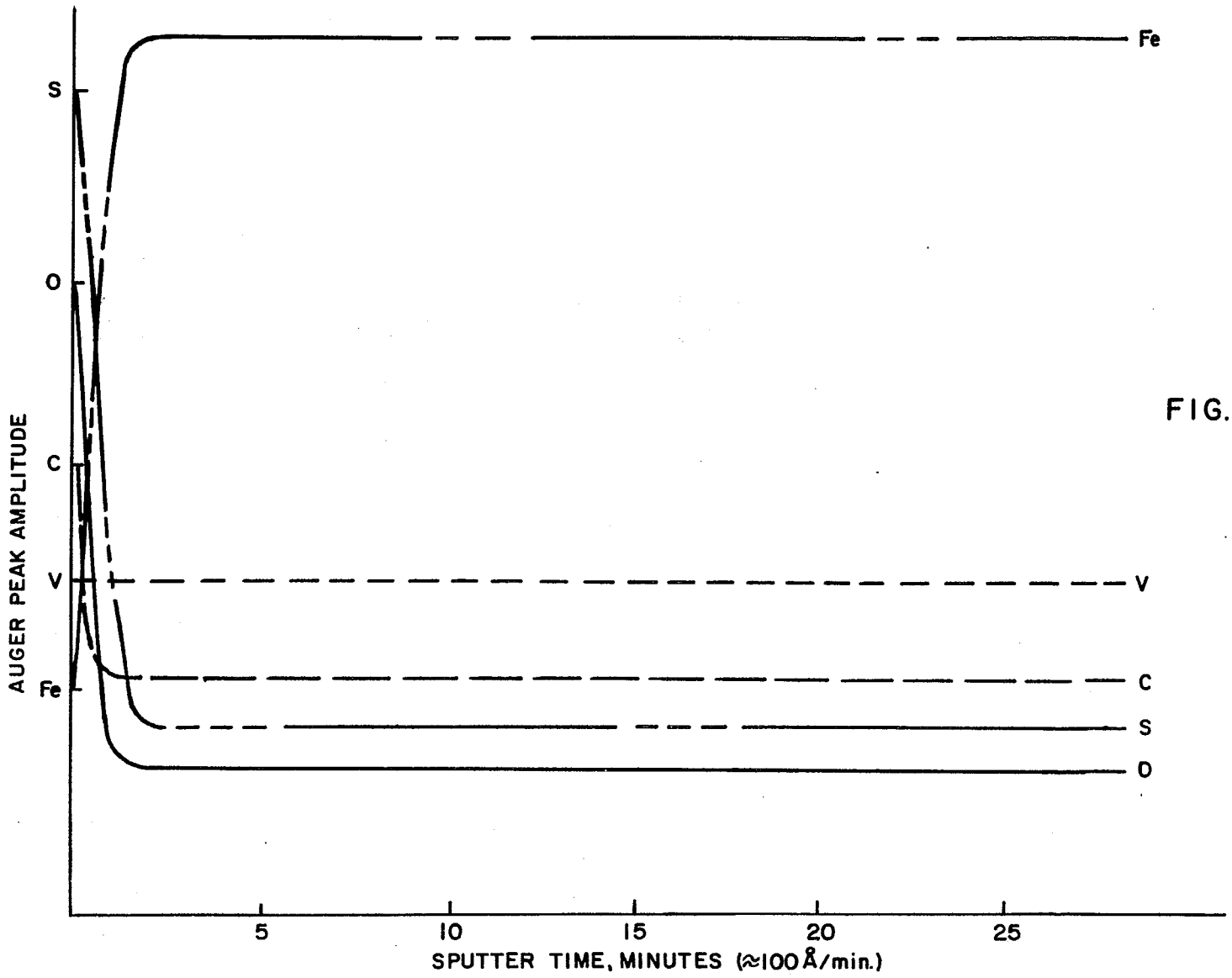

The present invention relates generally to a low alloy low carbon steel article having a non-ferrous metal protective coating and more particularly to an aluminum coated low alloy low carbon killed steel strip or sheet which has increased resistance to subsurface oxidation at elevated temperatures and which is particularly suitable for use in automotive exhaust systems, e.g. an exhaust muffler.

It is important to be able to increase the resistance of steel to oxidation at elevated temperatures in an inexpensive manner and without employing large amounts of costly alloying elements, while at the same time using conventional continuous hot-dip coating apparatus and coating procedures.

One method of increasing the oxidation resistance of the steel has been to provide the steel with an aluminum surface coating, such as by continuous hot-dip coating a plain low carbon steel strip or sheet. However, when an aluminum coating containing up to about 11 wt. % silicon (Type I) is applied to a mild plain carbon steel and the coated product is heated while exposed to air, excessive subsurface oxidation of the steel (i.e. oxidation of the steel below the aluminum coating) occurs at temperatures above 1300° F., so that such aluminum coated steels are unsuited for prolonged service at temperatures above 1300° F. Also, a typical aluminum coated mild steel, such as AISI 1008 steel, having a substantially pure aluminum coating (i.e. a Type II aluminum coating) is not recommended for continuous usage at temperatures above about 1300° F., because of excessive subsurface oxidation.

It has heretofore been found that when a small amount of titanium is added to a mild low carbon steel and the steel aluminum coated, the aluminum coating exhibits improved high temperature subsurface oxidation resistance without requiring the presence of large amounts of chromium, nickel or other alloying elements which are not normally present in a low carbon steel (See Gomersall U.S. Pat. No. 3,881,880). However, when an endless strip formed of a low alloy titanium-containing low carbon killed steel is continuously hot-dip aluminum coated by a Sendzimir-type process in which the steel strip is subjected to an in-line continuous oxidation-reduction heat treatment prior to hot-dip aluminum coating, there are areas of pronounced titanium segregation, essentially as oxides of titanium, at the interface between the reduced iron surface layer and the steel base which remain after the in-line oxidation-reduction treatment of the strip. The outer surface of the subsurface segregation areas is composed essentially of a mixture of titanium dioxide and titanium oxide, while the intermediate portion thereof extending toward the interior of the base metal is composed primarily of titanium oxide with the interior of the base metal having the titanium in the metallic form. The titanium oxides which are formed in the segregation areas during the in-line heat treatment which precedes hot-dip coating are not completely reduced to the metallic state when the strip passes through the reducing zone. These titanium oxide subsurface residues have been associated with failures in the adherence of the aluminum coating and poor wetability of a hot-dip aluminum coating, particularly when applying an aluminum-silicon alloy hot-dip coating by a Sendzimir-type hot-dip aluminum coating process.

It is therefore an object of the present invention to provide a hot-dip aluminum coated low alloy low carbon killed steel article, particularly steel in the form of continuous sheets or strips, having improved resistance to subsurface oxidation at elevated temperatures and a reduced amount of subsurface segregation of alloying element which is added to improve the oxidation resistance of the low carbon steel and which occurs when the steel is heated in an oxidizing atmosphere, such as during the in-line heat treatment of the steel when the steel is hot-dip aluminum coated by a Sendzimir-type continuous hot-dip coating process.

Another object of the present invention is to provide an improved hot-dip aluminum coated low alloy low-carbon killed steel article, particularly endless steel sheet or strip material characterized by having improved resistance to oxidation at elevated temperatures and a reduced amount of subsurface oxidation and oxide segregation formed during continuous hot-dip aluminum coating of the steel.

Still another object of the present invention is to provide an economical hot-dip aluminum coated low alloy low-carbon killed steel article having improved resistance to oxidation at elevated temperatures and which has improved wetability when coated by a Sendzimir-type continuous hot-dip aluminum coating process.

A further object of the present invention is to provide an improved process of forming a hot-dip aluminum coated low alloy low carbon killed steel article having improved resistance to subsurface oxidation at elevated temperatures.

Figure 2:
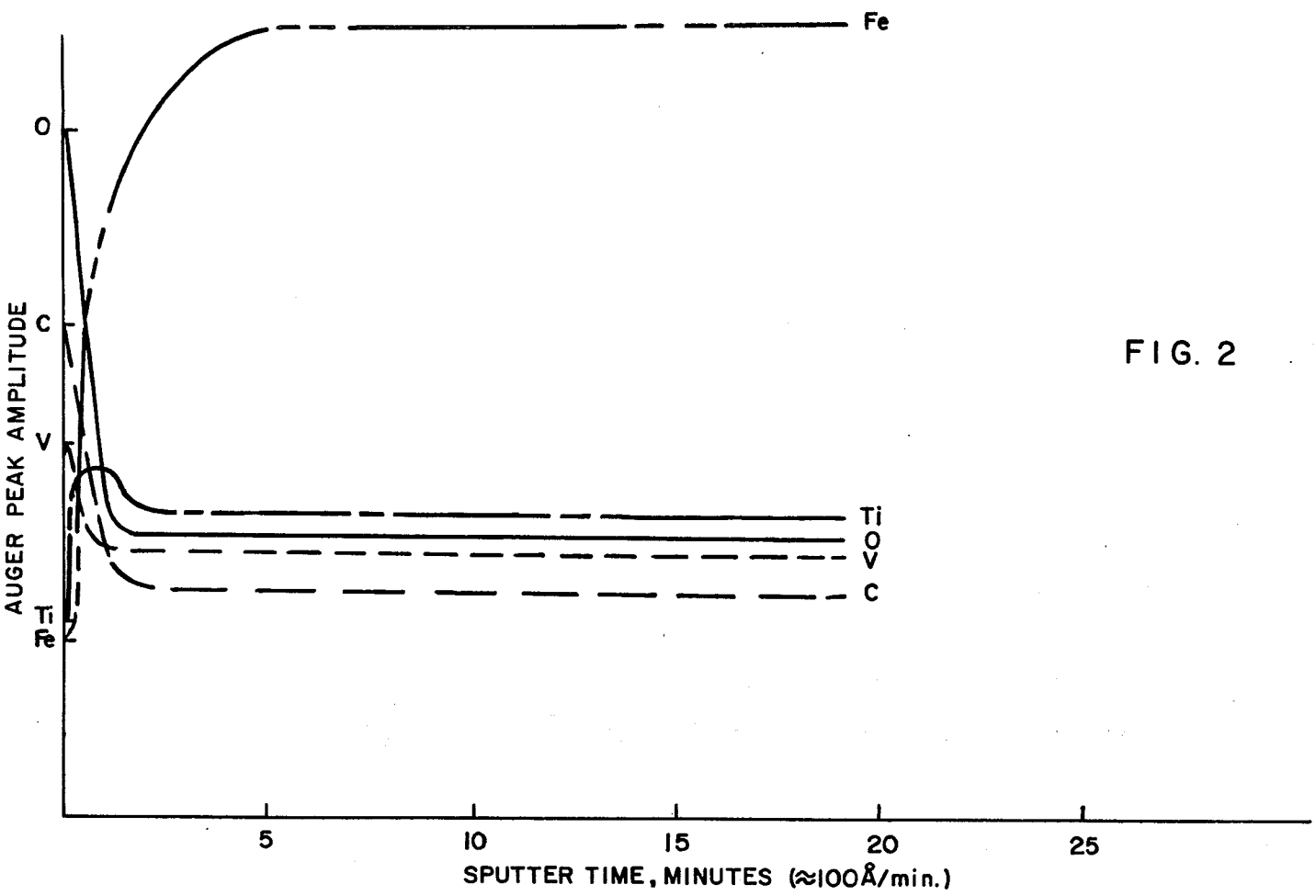
Figure 3:
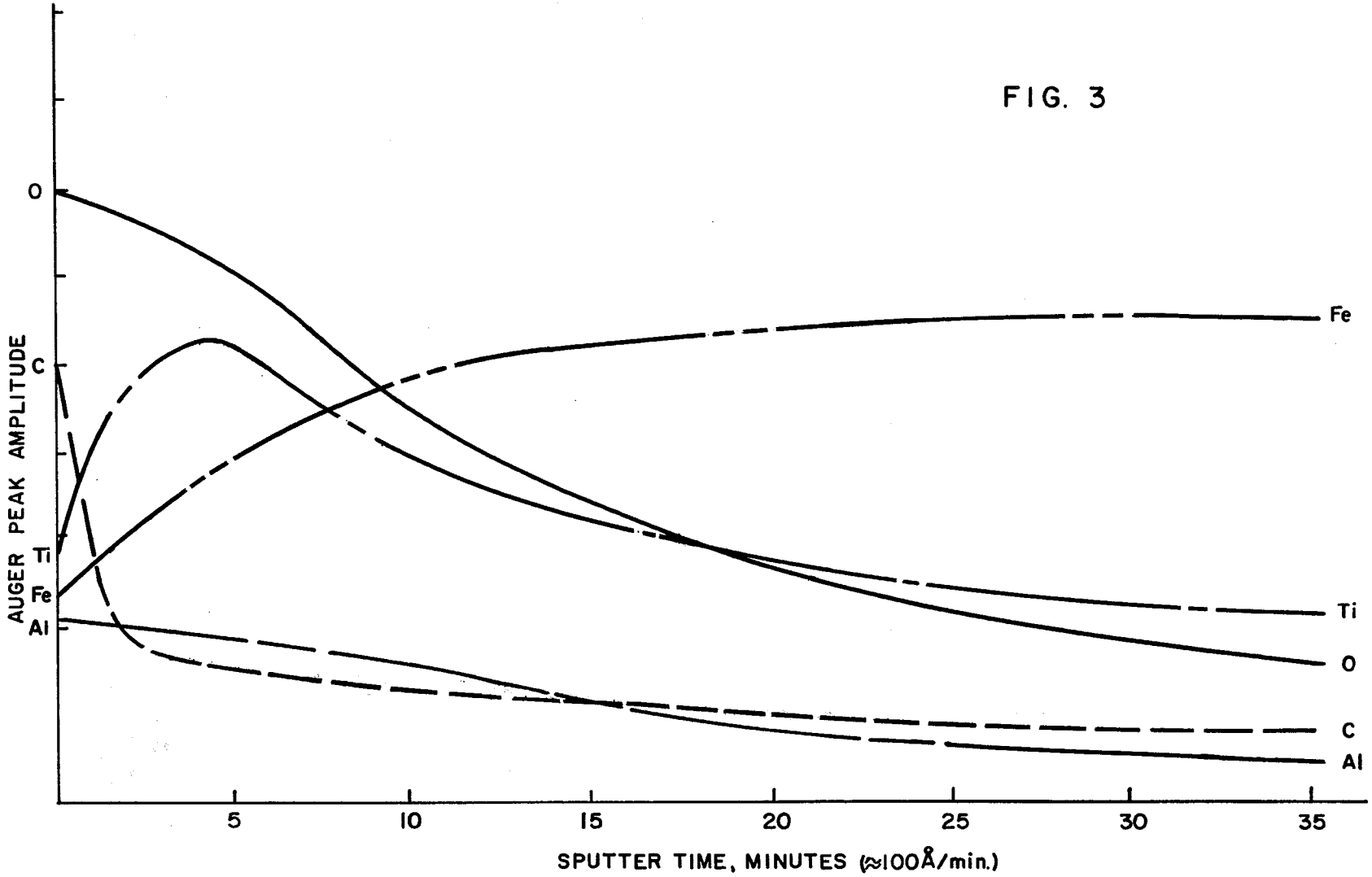

Other objects of the present invention will be apparent to those skilled in the art from the detailed description and claims to follow when read in conjunction with the accompanying drawing, wherein FIG. 1 is an AES depth profile of a low alloy low carbon aluminum killed steel strip which contains 0.40 wt. % vanadium after a heat treatment of the steel strip by a process simulating closely the oxidation-reduction heat treatment conventionally used in the present day commercial production of hot-dip aluminized steel sheet material;

FIG. 2 is an AES depth profile of a low carbon aluminum killed steel strip containing 0.1 wt. % vanadium and 0.3 wt. % titanium after a heat treatment of the steel strip by the process simulating closely the oxidation-reduction heat treatment conventionally used in the present day commercial production of hot-dip aluminized steel sheet material; and FIG. 3 is an AES depth profile of a low carbon aluminum killed steel strip containing 0.39 wt. % titanium after a heat treatment of the steel strip by the process simulating closely the oxidation-reduction heat treatment conventionally used in the present day commercial production of hot-dip aluminized steel sheet material.

The foregoing objects can be achieved and an aluminum coated low alloy low carbon killed steel article, particularly continuous steel sheets or strips, having an increased resistance to subsurface oxidation when heated at an elevated temperature in an oxidizing atmosphere can be provided economically with conventional apparatus and without using large amounts of expensive alloying elements by incorporating in a plain low alloy low-carbon killed steel used to form the steel strip before aluminum coating a small amount of vanadium sufficient to combine with or precipitate any carbon remaining in the steel base and leave an excess of uncombined vanadium in solution in the steel base.

Where the only alloying element added to the low alloy, low carbon killed steel for the purpose of improving the high temperature oxidation resistance of the aluminum coated said steel is vanadium, the weight percent vanadium added to the steel as the essential alloying element must be at least four times the weight percent of any uncombined carbon remaining in the steel in order to chemically combine with essentially all the carbon and nitrogen remaining in the steel and preferably provide an additional amount of vanadium sufficient to provide an excess of from about 0.1 to about 0.3 percent by weight uncombined vanadium in the steel. While the vanadium content can be as much as ten times the weight percent of carbon in the steel, an amount of vanadium greater than that specified herein gives no increased benefits and merely adds unnecessarily to the cost. And, since the amount of carbon in a steel conventionally used for producing aluminum coated steel strips is small, generally less than 0.10 wt. %, the total amount of vanadium required in the present invention is relatively small. The inclusion of vanadium in the steel in the aforementioned amounts also results inherently in stabilization of any nitrogen in the steel which usually does not exceed about 0.006 wt. %, so that both the carbon and nitrogen are stabilized, probably as vanadium carbides or vanadium carbonitrides.

Although vanadium is the essential alloying element to be added in a small amount to the plain or low carbon killed steel which is the basic material used in the present invention in order to obtain the advantages of the present invention, it is also within the scope of the invention to add to the steel in addition to the vanadium a small amount of titanium or other metallic alloying elements which will also combines with any carbon remaining in the killed steel or which will impart particular physical properties to the base steel. However, the total amount of the added metallic alloying elements not normally present in a plain or low carbon steel should not exceed about 1% by weight and preferably should not exceed about 0.5% by weight. Thus, the steel of the present invention in every case is a low alloy steel.

When the alloying elements added to the low alloy low carbon killed steel is a combination of vanadium and titanium, the combined total weight percent of vanadium and titanium should preferably be about 0.4 wt. % of the steel, with the vanadium and titanium alloying elements being present in any combination which will preferably provide a combined total of about 0.4 wt. %, preferably providing about 0.1 wt. % metallic chemically uncombined vanadium in the low carbon steel after all the carbon and nitrogen remaining in the steel are in a chemically combined form. For example, the steel in one preferred embodiment can contain 0.3 wt. % vanadium and about 0.1 wt. % titanium or can contain about 0.1 wt. % vanadium and 0.3 wt. percent titanium. When less than about 0.1 wt. % vanadium is used in combination with titanium, the improved wetability and reduction in segregation of titanium is not achieved.

The plain carbon or low carbon killed steel base used in the present invention and to which the vanadium or vanadium and titanium are added preferably is a low carbon steel or mild steel having a carbon content of up to about 0.25 wt. % max., usually from about 0.03 wt. % to about 0.25 wt. % and preferably from about 0.03 wt. % to about 0.10 wt. %, and preferably having vanadium added thereto in an amount which is sufficient to combine with all the carbon and nitrogen remaining in the steel base and leave an excess of chemically uncombined vanadium. Typically, a low alloy, low carbon aluminum killed steel base before the addition of vanadium or other alloying elements will consist essentially of from about 0.03 wt. % to about 0.25 wt. % carbon (preferably, 0.03 wt. % to 0.10 wt. % carbon), from about 0.20 wt. % to about 0.50 wt. % manganese, 0.03 wt. % sulfur, 0.02 wt. % phosphorus, 0.002 wt. % silicon, and 0.005–0.09 aluminum with the balance being essentially iron with the usual amount of residuals and impurities. While the steel used is a killed steel, and preferably aluminum killed steel, a like amount of another deoxidizer, such as silicon, can be used to kill the steel.

A preferred method of aluminum coating a steel strip having the vanadium content thereof in accordance with the present invention is by a hot-dip coating process generally known in the art as a Sendzimir-type process, wherein a continuous steel sheet or strip which after pickling is free of scale and rust and is fed continuously from a coil through a furnace containing an oxidizing atmosphere maintained at a temperature ranging between about 330° F. and 2400° F. in order to burn off any oil residue on the surface of the strip and forms a thin surface oxide film. The oxide coated steel sheet then passes through a furnace containing a reducing atmosphere, such as the hydrogen-containing HNX atmosphere, having a temperature between about 1500° F. and 1800° F., whereby the oxide coating on the strip is reduced to form a surface layer of metal free of nonmetallic impurities to which molten aluminum readily adheres. Following the reducing step, the strip is fed into a hot-dip aluminum coating bath through a protective hood which prevents the reduced metal surface being oxidized before entering the coating bath. The aluminum coating bath, for example, can be substantially pure aluminum (i.e. Type II aluminum coating) or an aluminum rich alloy, such as aluminum containing up to 11% by wt. silicon (Type I aluminum coating). After leaving the hot-dip aluminum coating bath, the coating thickness on the strip is controlled by coating rolls or preferably regulated by a pair of oppositely disposed thickness-regulating jet wipers which produce a uniform thin aluminum coating on the strip.

When a steel strip having a vanadium content or a vanadium-titanium content in accordance with the present invention is hot-dip aluminum coated by the herein described Sendzimir-type process or by any equivalent process which subjects the steel to heat treatment before or after aluminum coating, it has been found that the subsurface segregation of vanadium and titanium in the area of the interface between the reduced iron layer and the base metal is minimal, the strip is uniformly wetted by the hot-dip aluminum coating bath, and the formation of areas of thick subsurface metallic oxide is prevented or substantially retarded so that aluminum from the aluminum coating diffuses uniformly into the substrate steel base and thereby increases the resistance of the steel substrate to oxidation when the strip is exposed to an oxidizing atmosphere at elevated temperatures. The diffusion of aluminum into the steel base greatly increases the resistance of the steel base to subsurface oxidation.

A test Panel A of a laboratory-produced vanadium-bearing steel was made in accordance with the present invention having as the essential chemical analysis: 0.03 wt. % carbon, 0.45 wt. % manganese, 0.40 wt. % vanadium, and 0.08 wt. % aluminum with the balance essentially iron and the panel was heat treated to simulate closely the oxidation-reduction heat treatment used in the mill prior to hot-dip aluminum coating. The heat treated panel was then subjected to Auger Electron Spectroscopy (AES) examination. The AES depth profile is shown in FIG. 1 of the drawing.

A second test Panel B of a laboratory-produced vanadium-titanium-bearing steel having the following essential chemical analysis: 0.03 wt. % carbon, 0.45 wt. % manganese, 0.12 wt. % vanadium, 0.39 wt. % titanium, and 0.085 wt. % aluminum, with the balance essentially iron, after subjecting the panel to the same oxidation-reduction heat treatment used on Panel A was examined by Auger Electron Spectroscopy. The AES depth profile obtained is shown in FIG. 2.

A third test Panel C of a mill-produced titanium-bearing steel having as the essential chemical analysis: 0.03 wt. % carbon, 0.45 wt. % manganese, 0.39 wt. % titanium, and 0.085 wt. % aluminum with the balance essentially iron was subjected to the same oxidation-reduction heat treatment used on Panels A and B. The heat treated panel was then examined by Auger Electron Spectroscopy. The AES depth profile is shown in FIG. 3.

A summary of the Auger Electron Spectroscope (AES) analysis is given in the following Table I:

TABLE I

SUMMARY OF AES ANALYSES

| Sample History | | Concentration, Atomic Percent | | | | | |
|---|---|---|---|---|---|---|---|
| | | Fe | O | C | T; | V | Al |
| Lab heat 0.40% V; oxidized + reduced | Before sputter | 39.3 | 50.5 | 1.04 | — | <.1 | 2.74 |
| (Panel A) | After sputter | 93.7 | 2.75 | 1.46 | — | <.1 | 1.80 |
| Lab heat 0.1% V, 0.3% Ti; oxidized + reduced | Before sputter | 22.5 | 22.8 | 13.7 | 2.7 | 1.5 | 13.2 |
| (Panel B) | After sputter | 93.1 | (75 A) 1.1 | (50 A) 5.2 | (250 A) 0.6 | (200 A) — | — |
| Commercial Ti-Namel .39% Ti; oxidized + reduced | Before sputter | 18.7 | 19.8 | 18.1 | 4.1 | — | 18.4 |
| (Panel C) | After sputter | 90.1 | (1100 A) 1.8 | (25 A) 6.6 | (1000 A) 1.6 | — | — |

It is evident from the AES analysis (See Table I) and FIGS. 1-3 of the drawing that the thickness of the titanium oxide area of Panel C is about 1000° Angstroms, with the titanium concentration at a depth over about 1000° Angstroms from the surface is reduced from that closer to the surface. It is further apparent that after the oxidation-reduction heat treatment the titanium oxides in Panels B and C are not reduced to the metallic state but are left behind as an interface residue after the reduced iron layer is stripped.

It is also evident from a comparison of the analysis of the Auger Electron Spectroscopy data in Table I for Panels B and C that the subsurface segregation of titanium in Panel B with Vanadium present is suppressed significantly below the amount of titanium segregation which occurs in Panel C in the absence of vanadium. It will also be evident that the thickness of the oxide area in the test Panel B is reduced ten-fold by the addition of vanadium, since the oxide are thickness in Panel B is less than 100° Angstroms while the thickness of the titanium oxide area in Panel C is about 1000° Angstroms. From the AES depth profile of Panel A (See FIG. 1) it is evident that there is practically no surface segregation of vanadium in Panel A, since the depth profile remains practically unchanged over the entire range.

The precise mechanism by which the present invention retards segregation of the vanadium (and titanium when present) during the heat treatment of the strip in a Sendzimir-type hot-dip coating process or during subsequent exposure to elevated temperatures in an oxidizing atmosphere has not been determined. And, the reason vanadium in the specified amount prevents the formation of undesirable areas of subsurface oxides also is not entirely understood. It is presently believed, however, that the free or uncombined vanadium which is present throughout the steel base acts preferentially as a "getter" for oxygen and thus inhibits the formation of oxides below the surface. And, when oxides thereof are formed during heat treatment of the steel, the vanadium oxides are more readily reduced to the metallic state when exposed to a Sendzimir-type reducing atmosphere than are titanium oxides. Since vanadium is also a strong carbide and nitride former, it is essential to have present in the steel sufficient vanadium in excess of any uncombined carbon and nitrogen remaining in the steel to provide the required amount of free or uncombined vanadium after all of the carbon and nitrogen in the steel have combined with vanadium or any other added carbide former, such as titanium.

Although the amount of free or uncombined metallic vanadium required is relatively small (preferably from about 0.1 to about 0.3 wt. %), the vanadium should be present throughout the steel base so that a reservoir of vanadium is provided which has a protective and inhibiting effect on oxidation during prolonged exposure of the aluminum coated steel to a high temperature oxidizing atmosphere. As oxygen penetrates through minute cracks in the surface region of the coated steel, free vanadium becomes available to react with the oxygen, thereby minimizing the formation of the undesirable subsurface areas of oxides as a barrier. In the absence of a substantial reservoir of free vanadium, the desired protective effect is soon lost and the undesired oxides formed. And, by reducing the rate of diffusion of vanadium (and titanium where present) from the bulk of the metal toward the surface at high temperatures, the useful life of the coated article can be prolonged.

As previously mentioned, the aluminum coated steel sheet or strip of the present invention is specially suited for use in fabricating components of an automotive exhaust system, particularly exhaust mufflers but also other parts of the exhaust train, such as inlet pipes, tail pipes, Y-pipe assemblies, and catalytic converters. Not only does the aluminum coated vanadium-containing steel of the present invention have excellent wetability by molten aluminum and good high temperature oxidation resistance, as described above, but it also possesses good formability and other desirable physical properties, such as good high temperature tensile properties at elevated temperatures, all of which are required for fabricating mufflers and other automotive exhaust components.

While the foregoing disclosure relates primarily to improving the oxidation resistance of strips and sheets of steel of the type conventionally used for continuous hot-dip coating, it should be understood that the invention is not limited to steel strips and sheets, and in the claims which follow the term "steel material" or "steel article" includes any steel material regardless of size or shape, including both hot and cold rolled steel strip material and steel wire, suitable for coating with aluminum. It will also be understood that the terms "aluminum coating" and "aluminum coated" as used in the claims are intended to cover pure aluminum which contains only traces of other elements as well as aluminum rich alloys containing added ingredients such as zinc, magnesium, silicon, copper, beryllium, etc. Other methods and means for applying the aluminum coating to the steel article can also be used such as spraying, cladding, and the like, and the invention is not limited to applying the aluminum by the hot-dip coating procedure specifically disclosed.

I claim:

1. An aluminum coated low alloy steel article which has good formability and has good subsurface oxidation resistance and tensile properties when heated at an elevated temperature in an oxidizing atmosphere consisting essentially of an aluminum killed low carbon steel base having a maximum of 0.25 wt.% carbon and a maximum of metallic alloying additive of about 1% by wt., said steel having vanadium added as the essential alloy element uniformly distributed throughout the steel in an amount which combines with any uncombined carbon and nitrogen remaining in the steel and providing an excess of between about 0.1 and about 0.3 weight percent of uncombined vanadium throughout the steel, and a uniform thin hot-dip coating of metallic aluminum directly on a surface of said steel base free of oxides and nonmetallic material which interferes with the formation of said thin aluminum coating by a Sendzimir type hot-dip coating line, said low alloy steel article in the as-coated condition exhibiting good formability and when heated in an oxidizing atmosphere at an elevated temperature of about 1500° F. exhibiting good subsurface oxidation resistance and tensile properties.

2. The article of claim 1, wherein said steel base is an aluminum killed steel containing from about 0.005 wt. percent to about 0.09 wt. percent aluminum.

3. The article of claim 1, wherein the carbon content of said steel base is from about 0.03 wt. percent to about 0.10 wt. percent.

4. The article of claim 1, wherein said aluminum coating contains up to about 11 wt. percent silicon.

5. The article of claim 1, wherein said aluminum coating is substantially pure aluminum.

6. The article of claim 1 further characterized in that upon exposure of said steel base to an oxidizing-reduction atmosphere at an elevated temperature formation of an area of surface oxide segregation in said steel base is avoided.

7. An aluminum coated titanium-containing low alloy steel article which has a uniform thin hot-dip coating and which is resistant to surface and subsurface oxidation when heated in an oxidizing atmosphere at an elevated temperature of about 1500° F. prior to immersing in a hot-dip coating bath consisting essentially of:

an aluminum killed mild steel base having a maximum of 0.25 wt.% carbon with a maximum metallic additive of about 1 wt. % containing both titanium and vanadium in an amount which together consists of between four times and not substantially in excess of about ten times the amount of uncombined carbon in said steel base and which chemically combines with said uncombined carbon and any nitrogen in said steel base and provides an excess of between about 0.1 and about 0.3 weight percent of chemically uncombined vanadium distributed through the steel;

a metallic aluminum surface coating directly on a clean oxide-free surface of a steel base; and said article being characterized by the elimination of areas of surface titanium oxide segregation normally formed when a steel base containing-titanium is heated in an oxidizing-reduction atmosphere at an elevated temperature prior to immersing said strip in an aluminum hot-dip coating bath.

8. An aluminum coated steel article as in claim 7, wherein said steel base contains at least 0.1 wt. % titanium.

9. An aluminum coated steel article as in claim 7, wherein said steel base is a low carbon steel containing a maximum of about 0.05 percent by weight carbon; about 0.3 wt. % titanium and about 0.1 wt. % vanadium.

* * * * *